United States Patent [19]

Hart

[11] 4,287,699

[45] Sep. 8, 1981

[54] CARRIER APPLICATOR

[75] Inventor: William F. Hart, Lynchburg, Va.

[73] Assignee: Dacam Corporation, Madison Heights, Va.

[21] Appl. No.: 94,807

[22] Filed: Nov. 15, 1979

[51] Int. Cl.[3] ..... B65B 21/02

[52] U.S. Cl. ..... 53/48

[58] Field of Search ..... 53/48, 134, 49

[56] References Cited

U.S. PATENT DOCUMENTS

| | | | |
|---|---|---|---|
| 3,187,479 | 6/1965 | Ganz | 53/48 X |
| 3,867,807 | 2/1975 | Doucette | 53/48 |
| 3,877,198 | 4/1975 | Vergobbi | 53/48 |
| 4,018,027 | 4/1977 | Curry et al. | 53/48 |

*Primary Examiner*—Horace M. Culver

*Attorney, Agent, or Firm*—James & Franklin

[57] ABSTRACT

Plastic carriers are automatically applied to sets of containers by placing the carriers on the containers with recesses in the carrier aligned with the tops of the containers. Each recess is provided with a plurality of container engaging protrusions adapted to be seated below flanges on the containers. Sets of upstanding discs are situated to exert progressively increasing forces on the carrier top surface to seat the protrusions. A final set of concave discs are deformed in accordance with the curvature of the containers in order to insure sufficient contact between the disc rims and the narrow shoulder along the outer periphery of the carrier top surface, such that the container engaging projections adjacent to the shoulder are properly seated.

10 Claims, 11 Drawing Figures

CARRIER APPLICATOR

BACKGROUND OF THE INVENTION

The present invention relates to apparatus for automatically applying carriers to sets of containers in a high speed, continuous-flow packaging operation and, more particularly, to a carrier applicator having improved means for insuring positive engagement of the containers on the carrier.

Liquid containers such as glass or plastic bottles and jars in which carbonated beverages, juices, fruit drinks and the like are packaged, are often sold in multiples as a unit containing six, eight or twelve containers each. In order to maintain the containers as a unit and to protect the containers from damage and dirt during shipping, as well as to provide a convenient way to handle the containers, a carrier is often provided for the containers. The carriers have, in the past, commonly been formed of a paper product, such as cardboard, but more recently, carriers composed of plastic material have been utilized because same are inexpensive to manufacture and are of relatively high strength.

The structure of plastic carriers designed to accommodate multiple containers are known in the art and have been the subject of various patents, such as U.S. Pat. No. 3,871,699 entitled "Plastic Jacket For Containers", issued Mar. 18, 1975, and U.S. Pat. No. 3,912,075 entitled "Plastic Carrier For Containers", issued Oct. 14, 1975. The carrier commonly consists of a one-piece thermally formed plastic receptacle designed to enclose and engage the upper portion of each of the containers. The carrier is formed with a number of compartments, each of which is contoured in accordance with the upper portion of the container. Each container is inserted into and suspended from a recess in the compartment in "snap-fit" fashion, by seating a plurality of projections, extending inwardly from the recess, below a radial bulge or flange situated on the neck of the container.

On certain types of containers, an annular protrusion or flange is situated on the neck of the container immediately below the area upon which the cap or closure is placed. On other types of containers, the cap or closure has an inwardly directed bottom portion which surrounds the annular projection or flange on the container and which is designed to be broken away when the cap or closure is twisted off the container. In either case, the neck of the container is provided with an annular projection or flange which has a diameter greater than the section of the neck of the container immediately below same.

Each of the recesses in the carrier, into which the upper portion of a container will be received, is provided with a set of diametrically opposed, inwardly extending projections, which are preferably formed integrally with the carrier. The projections are, to some extent, flexible, such that as the top of the container is received within the recess, the flange or cap on the container will cam the projections out of the way. When the container is fully inserted within the recess, the resiliency of the projections causes same to lodge below the flange so as to engage the container and secure same to the carrier.

In order to insure that the containers will not dislodge from the carrier, it is necessary that each of the projections extending from each recess be correctly situated below the container flange. In order to seat the projections below the flange, it is necessary to support the containers and exert a downwardly directed force on the carrier, at a point thereon immediately adjacent each projection. However, in practice, it is difficult to exert the necessary downwardly directed forces on the carrier in the immediate vicinity of the projections adjacent the outer periphery of the carrier, because of the contours of the carrier.

More specifically, each compartment in the carrier is shaped or contoured in accordance with the shape of the upper portion of the container which same is designed to receive. Each compartment has a planar top surface upon which the container receiving recess is situated. Between the recess and the outer peripheral edge of the top surface is located a relatively narrow shoulder. The carrier is contoured such that the side thereof extends downwardly at a steep angle from the shoulder. Thus, in order to exert a downward force on the carrier immediately adjacent the projections along the outer periphery thereof, it is necessary to exert the force on the relatively narrow shoulder of the carrier. However, it is difficult to engage the shoulder of the carrier from above because the flange on the container obstructs all but the very narrow edge of the shoulder from above.

It is therefore extremely difficult to devise a system capable of engaging the shoulder from above and exerting the necessary downwardly directed forces thereon which are required to positively seat all of the projections below the flange of the container in every instance. It is even more difficult to perform this function when the operation is fully automated, particularly in a high-speed, continuous-flow packaging operation.

One attempt to provide an automated carrier applicator has been made by Owens-Illinois in its Model 104-200 carrier applicator. In this device, the containers are aligned on a first conveyor and the carriers flow along a second conveyor which is situated above the first. As the containers move along the first conveyor, a carrier is dispensed from the second conveyor and placed on top of the containers with the recesses in the carrier in alignment with the tops of the containers. The container-carrier assembly is then conveyed beneath a rotatable cylinder which has pairs of spaced apertures situated along the surface thereof. Each pair of apertures is spaced from the adjacent pair a distance which is substantially equal to the distance between the pairs of recesses on the carrier. In this manner, as the container-carrier assembly is conveyed beneath the cylinder, the cylinder rotates, the protruding container tops are received within the apertures on the cylinder surface and the surface of the cylinder exerts a downwardly directed force on the top surface of the carrier so as to seat the projections below the container flanges.

It has been found that this system performs satisfactorily with respect to the projections adjacent the central portion of the carrier top surface because there is sufficient area on the top surface of the carrier adjacent these projections to permit substantial contact between the surface of the cylinder and the surface of the carrier. However, the same is not true with respect to the projections along the outer periphery of the top surface of the carrier because there exists in these areas only a narrow shoulder, partially obstructed from above by the flange, upon which the forces may be applied. Precise alignment between the cylinder surface and the narrow shoulder of the carrier is required if the necessary downward force is to be exerted on the shoulder to seat the projections adjacent thereto. To further compound the problem, the apertures in the cylinder surface must be somewhat larger in diameter than the flanges. This is necessary to provide sufficient clearance for the container tops to be received within the apertures, as the cylinder rotates. It is, therefore, extremely difficult to positively cause the cylinder surface to adequately engage the narrow shoulder along the outer peripheral edge of the carrier. Thus, with the system proposed by Owens-Illinois, the projections adjacent the narrow shoulder, along the outer peripheral surface of the carrier, are often not correctly positioned below the container flange. When this occurs, the containers become dislodged from the carrier during shipping and handling, thereby negating the advantages of the use of the carrier.

It is, therefore, a prime object of the present invention to provide a carrier applicator wherein positive engagement of each container on the carrier is insured.

It is a further object of the present invention to provide a carrier applicator having improved means for positively seating the engaging means adjacent the outer periphery of the carrier.

It is a further object of the present invention to provide a carrier applicator which can be utilized in automated high-speed, continuous-flow packaging operations.

It is a further object of the present invention to provide a carrier applicator which utilizes concave deformable discs to accommodate the curvature of the containers and to permit increased contact with the narrow shoulder of the carrier.

It is a further object of the present invention to provide a carrier applicator wherein downwardly directed forces of progressively increasing magnitude are applied to the carrier.

It is a still further object of the present invention to provide a carrier applicator which is composed of relatively simple, inexpensive parts which function together in a reliable manner.

In accordance with the present invention, apparatus is provided for applying a carrier on a container. The container is of the type having a flange thereon below which means on the carrier are adapted to engage the container. The apparatus comprises means for placing a carrier on a container to form an assembly with the engaging means at least partially situated above the flange and means for seating the engaging means below the flange. The seating means comprises a deformable disc, means for moving the assembly along a path relative to the disc and means for rotatably mounting the disc in alignment with the path of movement of the assembly with at least a portion of the disc positioned to intersect the plane of the flange. In this manner, the disc contacts the assembly and is deformed by the container as the assembly is moved, so as to accommodate the contour of the container and applies a force on a sufficient area of the carrier to seat the engaging means below the flange.

The container has a curved surface. The mounting means comprises means for positioning the disc to contact the curved container surface and at least partially assume a curvature determined by the curved surface while in contact therewith. The disc is preferably concave in configuration and, thus, has a concave side. The disc positioning means positions the disc with the concave side facing the curved surface. The deformation of the disc permits the rim of the disc to positively engage the narrow shoulder along the outer periphery of the carrier over a substantially increased surface area.

Situated between the assembly forming means and the concave disc, along the path of movement of the assembly, are second and third planar discs. Means are provided for rotatably mounting the second disc, for contact with the assembly, a given distance from the moving means. Means are provided for rotatably mounting the third disc, for contact with the assembly, at a distance less than the given distance from the moving means. In this manner, the second and third discs exert progressively increasing forces on the carrier as same is moved along its path of movement.

Thus, after the carrier is properly positioned on top of the containers, the containers are moved along a path by a conveyor and passed beneath sets of planar rotatable discs, preferably also deformable, which exert progressively increasing downwardly directed forces on the carrier to cause the engaging means situated along the central portion of the top surface of the carrier, and, in some instances, certain of the engaging means situated along the outer periphery of the top surface of the carrier, to be seated beneath the flanges on the carriers. The planar discs, although also preferably composed of deformable material and thus designed to accommodate the contours of the containers to a certain extent, normally deform in a manner which provides insufficient contact area between the rims thereof and the narrow shoulder along the outer periphery of the top surface of the carrier. Thus, the engaging means adjacent the outer periphery of the top surface of the carrier may not be positively seated below the flanges on the adjacent containers by the planar discs.

For this reason, the final set of deformable rotatable discs has a dish-shaped or concave structure such that same may more readily accommodate the curvature of the containers and the rims thereof will contact the narrow shoulder of the outer periphery of the top surface of the carrier over a sufficient surface area to insure that the engaging means on the outer periphery of the top surface of the carrier are positively seated below the container flanges.

To the accomplishment of the above and to such other objects as may hereinafter appear, the present invention relates to a carrier applicator, as described in the following specification and recited in the annexed claims, taken together with the accompanying drawings, wherein like numerals refer to like parts, and in which:

Figure 1:
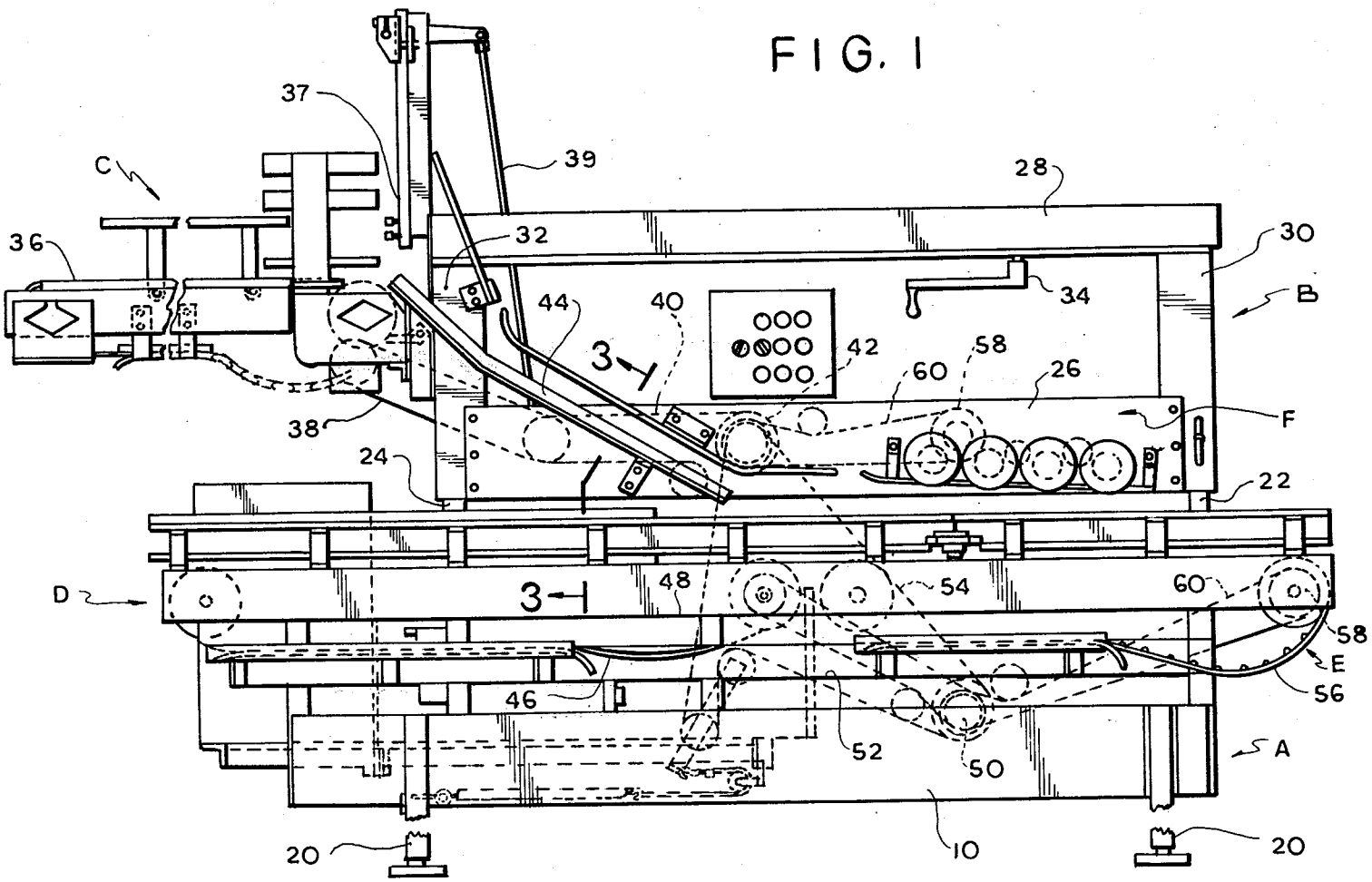
FIG. 1 is a side view of the carrier applicator of the present invention.
Figure 2:
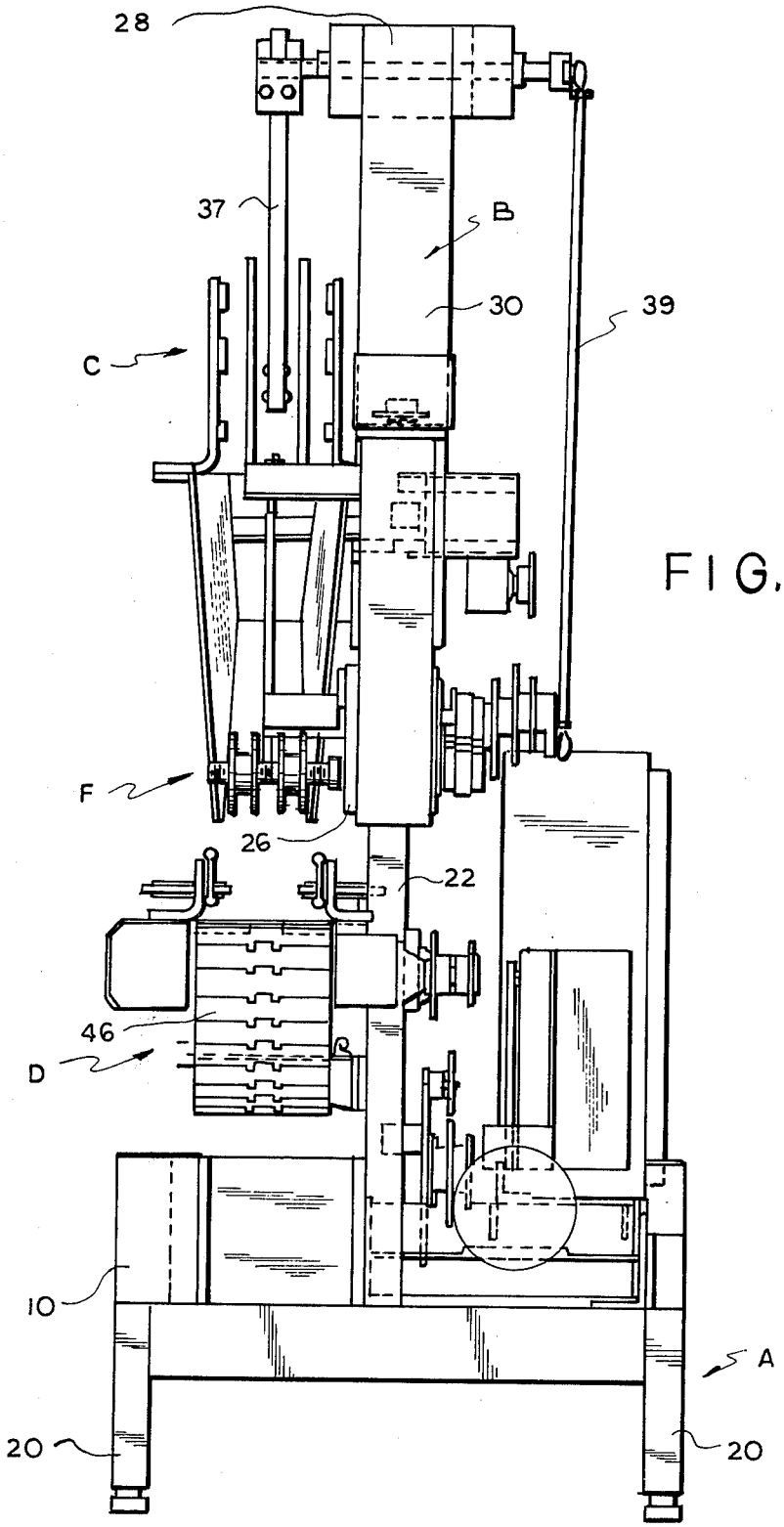
FIG. 2 is a front view of the carrier applicator of the present invention.

FIGS. 1 and 2 show side and front views of the first preferred embodiment of the carrier applicator of the present invention. The carrier applicator comprises a support including a table-like base, generally designated A, upon which a position adjustable upstanding frame, generally designated B, is mounted. Frame B, at its input end (left, as seen in FIG. 1), has mounted thereon a carrier distribution means, generally designated C. Immediately below carrier distribution means C and situated on base A is a double lane bottle conveyor, generally designated D.

Incoming bottles are conveyed in a double lane along bottle conveyor D. As the bottles reach the end of bottle conveyor D, they pass beneath the output side of carrier distribution means C and a carrier is placed thereon, with the tops of the bottles in alignment with the recesses in the carrier provided to receive same. The carrier container assembly then passes from bottle conveyor D to an assembly conveyor, generally designated E, also located on base A, adjacent the output end of bottle conveyor D. The assembly is conveyed beneath a seating means, generally designated F, mounted on frame B, as it is moved towards the output end of the carrier applicator (right, as seen in FIG. 1).

The preferred embodiment of the carrier applicator of the present invention is designed to accept a double lane of bottles and apply a plastic carrier of the 'neck-through' type to groups of bottles arranged in 2×2 four-bottle packs, 2×3 six-bottle packs, or 2×4 eight-bottle packs of six ounce, seven ounce, ten ounce or sixteen ounce size bottles with the roll-on, crimp-type or twist-off bottle closures. However, for purposes of illustration, a carrier applicator designed to form 2×3 six-bottle packs of bottles having roll-on bottle closures (screw caps) has been shown and described. From this description, it will be obvious to those skilled in the art how the carrier applicator of the present invention can be modified to package bottles of different types into units of a variety of different configurations. A second preferred embodiment is illustrated to show the manner in which the carrier applicator of the present invention can be modified to package two 2×3 six-bottle packs simultaneously, in side-by-side relation.

Base A has a structure including a horizontal frame member 10, preferably a hollow square tube or the like, and four position-adjustable upstanding legs 20 which are rigidly connected thereto by bolts or other conventional means. Extending upwardly from the center portion of base A are a pair of upstanding members 22, 24 upon which frame B is position-adjustably mounted.

Frame B comprises lower and upper horizontal members 26, 28, respectively, mounted between a pair of front and rear upstanding members 30, 32, respectively. Upstanding members 30 and 32 of frame B are provided with internal recesses (not shown) into which upstanding members 22, 24, respectively, extending upwardly from base A, are received. Thus, frame B and the carrier distribution means C and seating means F mounted thereto are vertically adjustable, as a unit, with respect to base A, such that bottles of different heights may be accommodated by the carrier applicator. The vertical position of frame B with respect to base A is adjusted by rotating a crank arm 34 located beneath horizontal member 28 of frame B.

Carrier distribution means C, mounted on frame B, comprises a carrier supply conveyor 36, of the continuous belt variety, which is powered by means of belts 38 and 40, the latter of which is connected to a sprocket 42, in turn, connected to the drive shaft of a motor (not shown). Carriers are conveyed along conveyor 36 until they reach the discharge end thereof. At that point, the carriers are picked off the conveyor, one at a time, by a sucker bar 37, which is mechanically driven by the motor by means of a linkage 39. Bar 37 deposits each carrier, in turn, on a gravity-feed guide 44 which guides the carriers from the level of carrier conveyor 36 to a position spaced above the surface of the bottle conveyor D located on base A.

Bottle conveyor D consists of an endless belt 46 wide enough to accommodate two lanes of bottles. Belt 46 is connected to a sprocket 48 which, in turn, is connected to a sprocket 50 by belt 52. Sprocket 50 is connected to sprocket 42, and thus the drive shaft of the motor (not shown) by a belt 54.

The output end of bottle conveyor D feeds the input end of assembly conveyor E which includes an endless belt 56 connected to a sprocket 58 which, in turn, is connected to sprocket 50 by belt 60. As noted above, sprocket 50 is connected to sprocket 42 and, thus, to the drive shaft of the motor (not shown) by belt 54.

Located above assembly conveyor E on frame B is seating means F which comprises a number of sets of rotatable discs, as described in detail below. The rotatable discs of seating means F are all operably drivingly connected to a sprocket 58 which, in turn, is connected to sprocket 42 by means of a belt 60.

It will now be appreciated that carrier conveyor 36, bottle conveyor D, assembly conveyor E and sealing means F are all drivingly connected, by means of belts, to sprocket 42 which, in turn, is connected to the output of the drive shaft of a motor (not shown). In this manner, the operation of the various components of the carrier applicator is synchronized. Further, only a single motor need be provided to operate the entire system.

Figure 3:
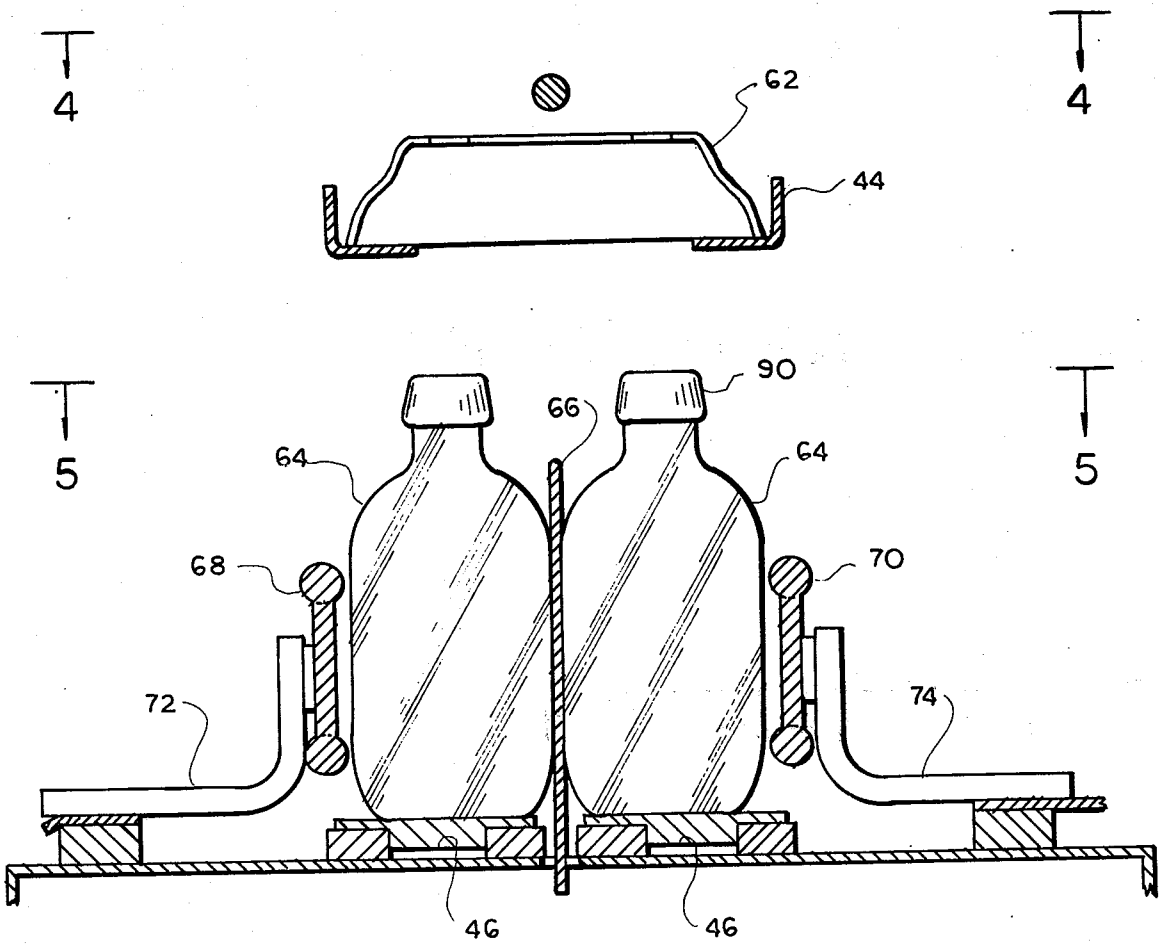
FIG. 3 is a front view of a portion of the carrier applicator, taken along line 3—3 of FIG. 1.
Figure 5:
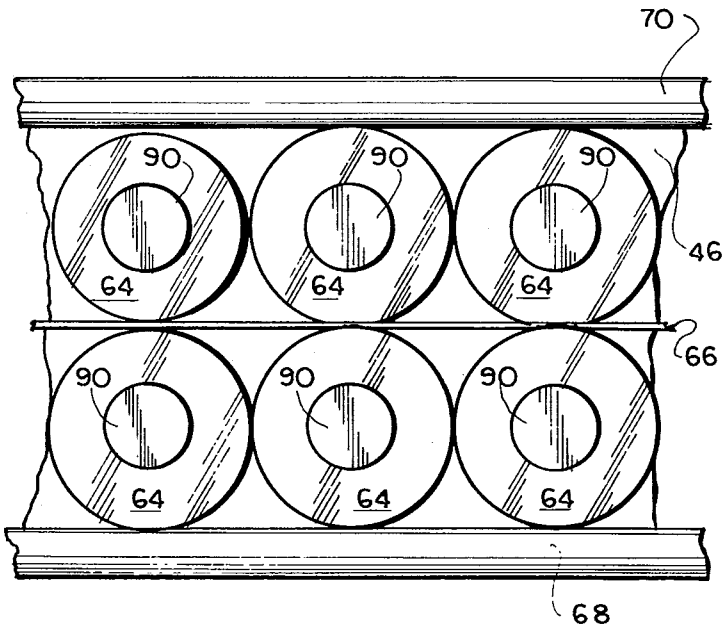
FIG. 5 is a top view of the containers taken along line 5—5 of FIG. 3.

FIG. 3 shows the positional relationship between a carrier 62 and a set of bottles 64 immediately before the carrier is dispensed from guide 44 onto the bottles located on bottle conveyor D. Bottle conveyor D is designed to convey two lanes of bottles 64 and, for this reason, endless belt 46 is divided by a divider 66 situated between the lanes. Guide rails 68, 70 supported on brackets 72, 74, respectively, are provided to guide the bottles 64 as they are conveyed along belt 46.

Figure 4:
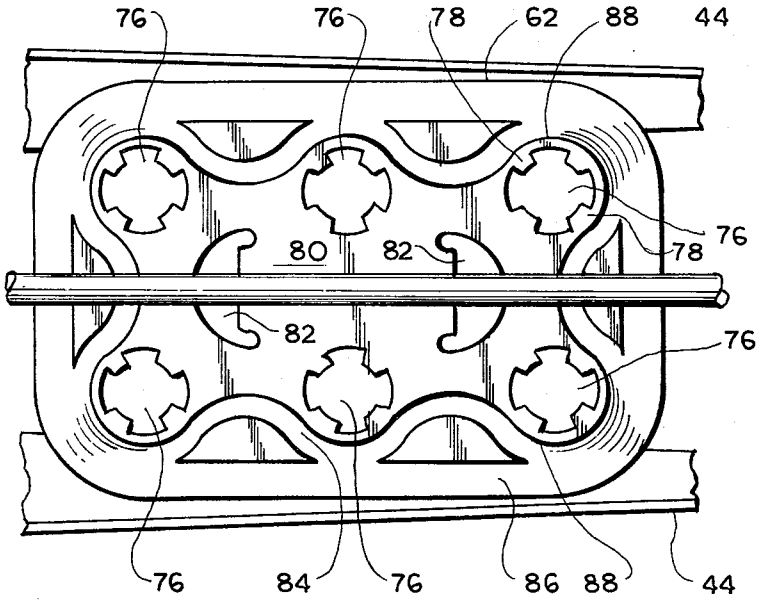
FIG. 4 is a top view of the carrier applicator, taken along line 4—4 of FIG. 3.

As best seen in FIG. 4, carrier 62 comprises a relatively thin sheet of plastic material which is formed into the shape illustrated. The carrier is designed to accommodate six bottles 64 in a 2×3 configuration. The carrier is divided into six compartments, each of which is designed to accommodate one bottle. At the top of each compartment is an opening 76 into which the top of a bottle 64 is designed to be received. Extending inwardly from the rim of each of the openings 76 are four diametrically opposed inwardly directed projections 78 which function as a means for engaging the neck of the bottle. Projections 78 are preferably integrally formed with the carrier and are composed of relatively flexible plastic.

The top surface 80 of the carrier is substantially planar and is provided with a pair of finger grip recesses 82 along with bottle receiving opening 76. The sides 84 of the carrier, which extend from planar surface 80 to the lower skirt 86 of the carrier are substantially vertical. A relatively narrow shoulder 88 which forms the outer peripheral edge of surface 80 is situated between each of the bottle receiving openings 76 and the substantially vertical side wall 84 of the carrier adjacent thereto.

The bottles 64 illustrated are of the roll-on cap type. Each bottle 64 is supplied with a screw cap 90 which seals the opening thereof and extends downwardly along the neck of the bottle from the mouth thereof and over an annular protrusion or flange (not shown) on the neck of the bottle. The lower portion of cap 90 has a "break-away" portion which, when cap 90 is twisted, will open, disengaging the cap from the flange and permitting the cap to be removed from the bottle.

Bottles 64 are suspended from carrier 62 by inserting caps 90 through openings 76 such that inwardly extending projections 78 are cammed out of the way and thereafter located beneath the flange on the bottle and thus beneath the lower "break-away" portion of cap 90 which surrounds same. In order for the bottles 64 to be properly attached to carrier 62, it is necessary that each of the inwardly extending projections 78 be located below the bottle flange. If one of the inwardly extending projections 78 is not properly seated below the flange, the bottle may become dislodged from the carrier during handling and/or shipping.

In order to properly seat the inwardly extending projections 78 beneath the bottle flanges, a seating means is provided which exerts a downwardly directed force on the top of the carrier to move same with respect to the bottles such that the bottle caps are situated above the planar top surface 80 of the carrier with the inwardly extending projections 78 situated below the bottle flanges. In order to insure that each of the projections 78 is properly seated, it is necessary to exert a downwardly directed force on the carrier immediately adjacent same. This is relatively easy to accomplish with respect to the projections situated adjacent the central portion of the top surface 80 because the planar structure of the central portion of top surface 80 has sufficient area for contact with the sealing means to insure that the downwardly directed forces applied thereby can be exerted immediately adjacent the projections 78 situated adjacent the central portion of surface 80. However, the same is not true with respect to the projections 78 adjacent narrow shoulder 88 on the outer periphery of surface 80. This is because of the extremely narrow contour of shoulder 88 and the fact that same may be partially obstructed from above because of the structure of bottle caps 90. It is for this reason that a seating means F of unique construction is required.

Figure 6:
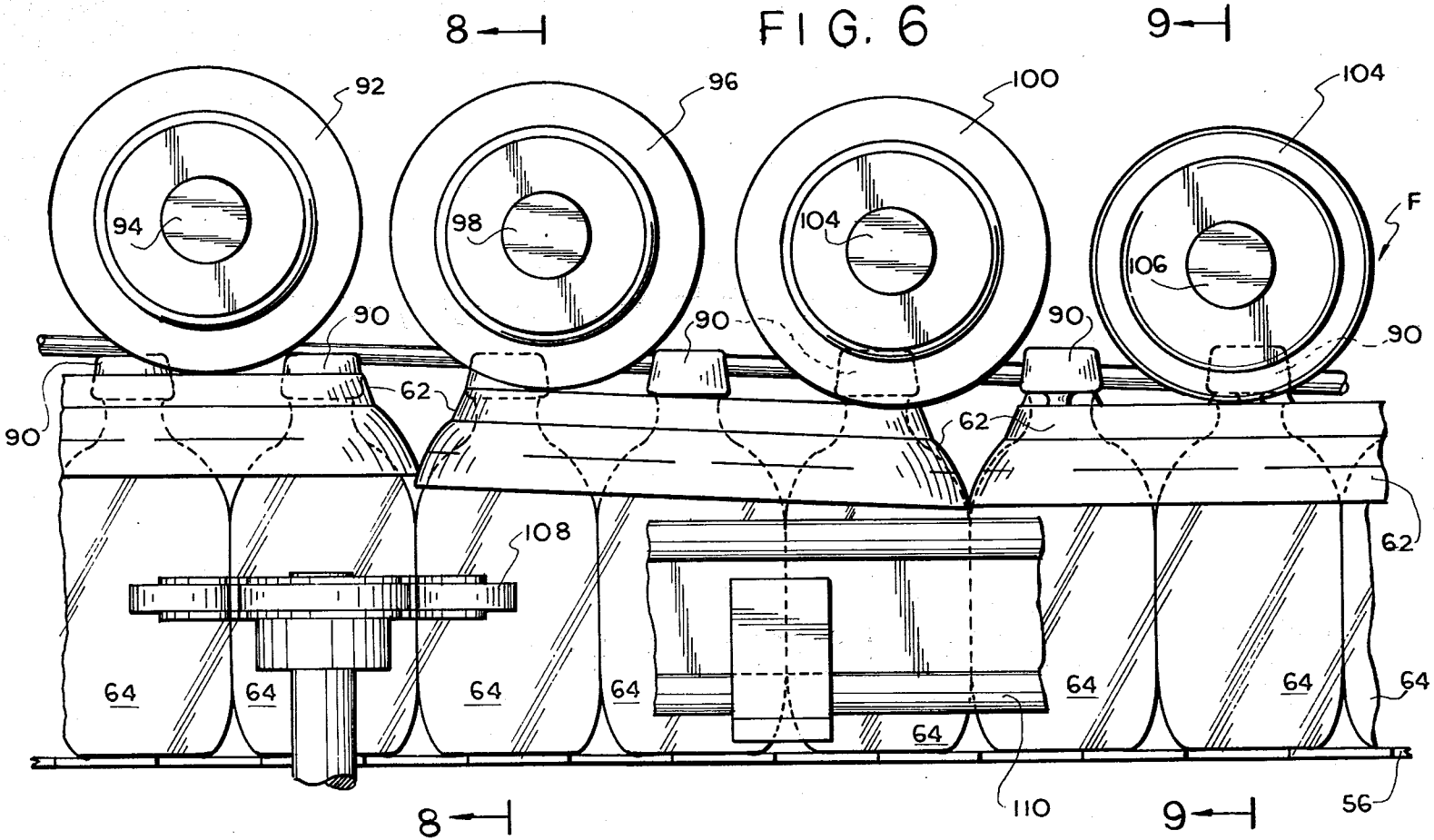
FIG. 6 is a side view showing the manner in which the discs act on the assembly in the carrier applicator of the present invention.
Figure 7:
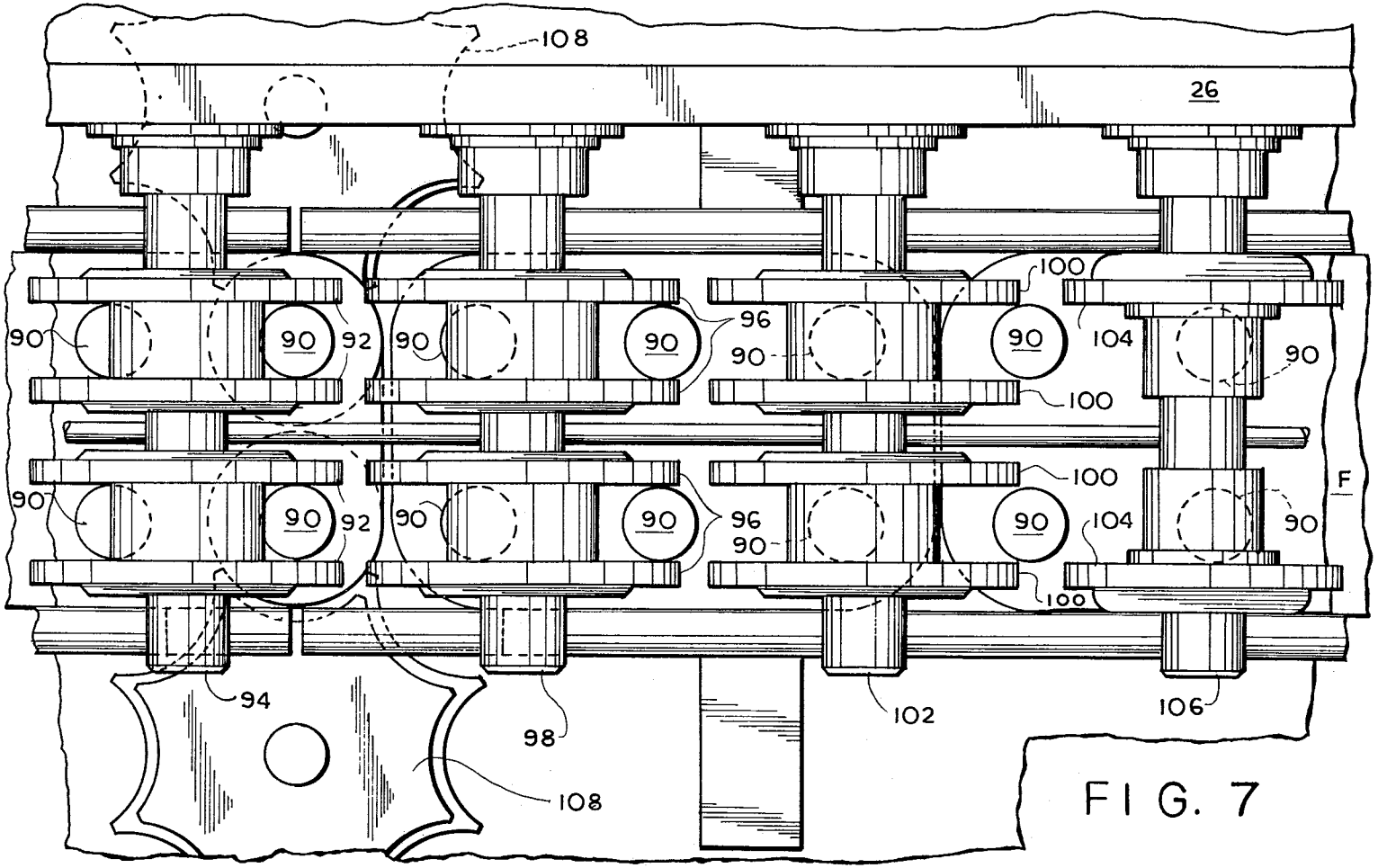
FIG. 7 is a plan view of the portion of the carrier applicator of the present invention shown in FIG. 6.

The seating means F of the present invention is illustrated in FIGS. 6 through 10. As shown in FIGS. 6 and 7, the seating means F comprises four sets of axially aligned rotatable discs, preferably composed of soft polyurathane, situated in sequence along assembly conveyor E. The first set of discs, located at the input end (left, as seen in FIGS. 6 and 7) of seating means F, consists of four substantially planar deformable discs 92, each of which is mounted on a rotatable shaft 94, which is operably connected to sprocket 58 to drive same. The next set of discs in sequence consists of four substantially planar deformable discs 96 mounted on a rotatable shaft 98 which is also operably connected to be driven by sprocket 58. The next set of discs in sequence consists of four planar deformable discs 100 mounted on a rotatable shaft 102 which is operatively connected to and driven by sprocket 58. The last set of discs in sequence, which is located at the output end of seating means F (right, as seen in FIGS. 6 and 7), consists of two concave shaped deformable discs 104 mounted on a rotatable shaft 106 which is operably connected to and driven by sprocket 58. Thus, the rotation of each of the shafts 94, 98, 102 and 106 is synchronized because same are all operatively interconnected and driven from the same source.

It will be appreciated from examination of FIG. 6 that the lower portions of the rims of discs 92, 96 and 100 are located at progressively decreasing distances from the top surface of belt 56 which forms assembly conveyor E. For this reason, the disc 92, 96 and 100 exert progressively increasing downwardly directed forces on the assembly as the assembly is moved by belt 56 beneath same. The lower portions of the rims of discs 92 are located in a plane slightly above the intermediate point of the bottle caps 90. The lower portions of the rims of discs 96 are located in a plane which is in proximity to the plane of the flange on the neck of the bottle. The lower portions of the rims of discs 100 are located in a plane somewhat below the plane of the flange on the bottles. In this manner, carrier 62 is gradually forced downwardly such that the caps 90 on the bottles 64 are received within openings 76.

A pair of rotatable starwheels 180 are provided, one on either side of belt 56, to insure the proper positioning of bottles 64 with respect to carrier 62. Starwheels 108 need not be power driven. In addition, a pair of upstanding guide rails 110, one of which is situated on each side of belt 56, are provided to guide the assemblies along the conveyor E.

In each of the sets of discs 92, 96, 100, two of the discs are provided for each lane of bottles 64. In each lane, the discs are spaced from each other by a distance slightly less than the diameter of cap 90, such that the discs are deformed to a slight extent as the cap passes therebetween. The two discs on the interior of each set are situated to make contact with the central portion of planar surface 80 of carrier 62. The two outer discs in each of these sets are situated to make contact with the narrow shoulder 88 which forms the outer periphery of planar surface 80 of carrier 62. However, because of the extremely narrow nature of shoulder 88, the outer discs in each set may not have sufficient contact area with shoulder 88 to insure that the projections 78 adjacent thereto are properly seated below the bottle flanges. It is for this reason that concave-shaped deformable discs 104 are provided. It should be noted that discs 104 are slightly smaller in diameter than discs 92, 96 and 100, but that the lower portions of the rims thereof are located the same distance from belt 56 as are the lower portions of the rims of discs 100 and, therefore, the lower portions of the rims of discs 104 are in substantially the same plane as the lower portions of the rims of discs 100.

Figure 8:
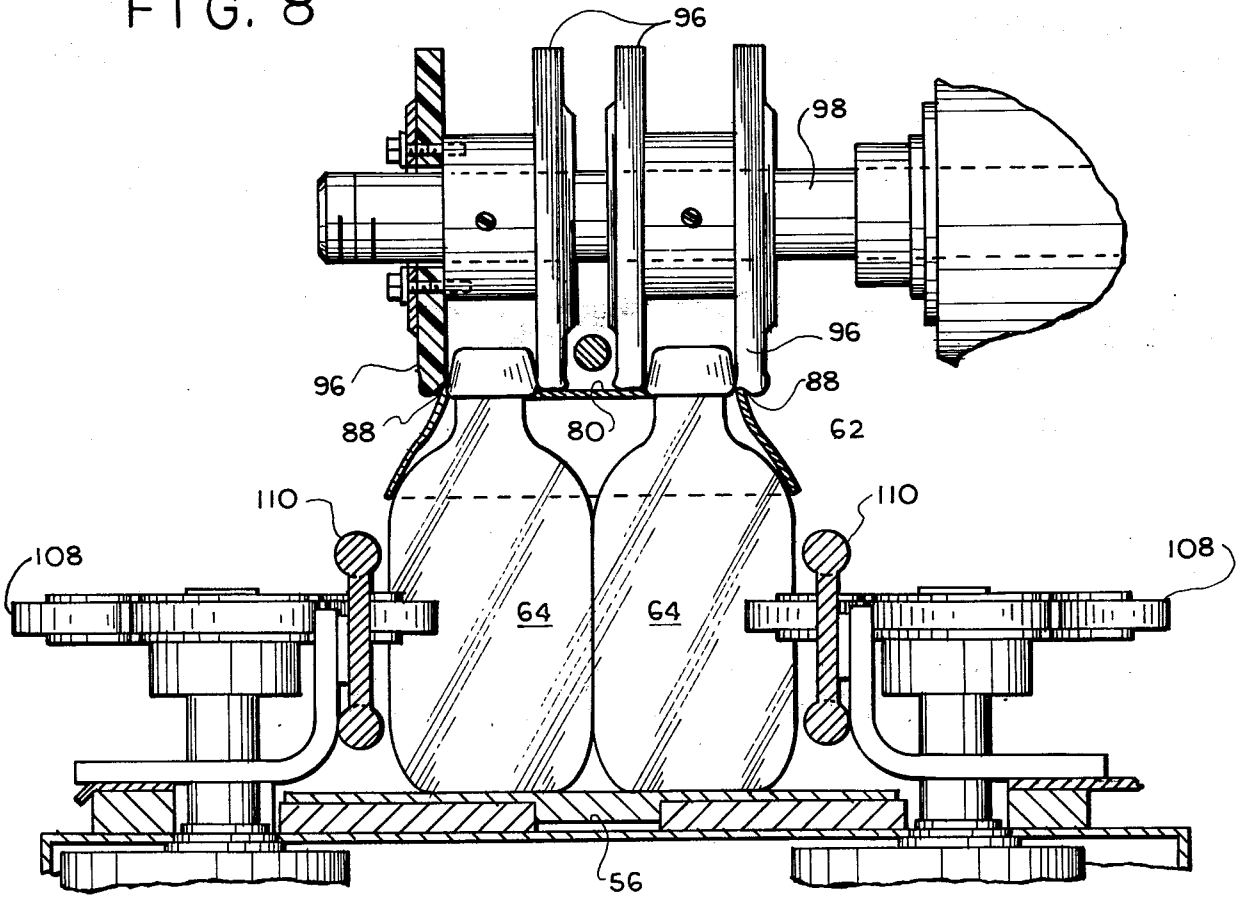
FIG. 8 is a front view taken along line 8—8 of FIG. 6.

FIG. 8 shows a cross-sectional view of seating means F taken along line 8—8 of FIG. 6. As can be readily appreciated from this drawing, discs 98 are substantially planar in configuration and the two interior discs 98 make contact with the central portion of planar top surface 80 of carrier 62 over a sufficient area of contact to provide substantial downwardly directed force thereon. Thus, the projections 78 adjacent the central portion of surface 80 will always be properly seated below the flanges of the bottles by discs 92, 96 and 100. However, the outer discs 96 of the set are positioned to contact carrier 62 along narrow shoulder 88. Because the width of shoulder 88 is quite small, only a relatively small portion of the rims of discs 88 make contact therewith. This is true even though the discs are made of deformable material because of the planar structure thereof. For this reason, the operation of discs 92, 96 and 100 will not always insure that the projections 78 adjacent shoulder 88 will be properly seated beneath the bottle flanges.

Figures 9, 10:
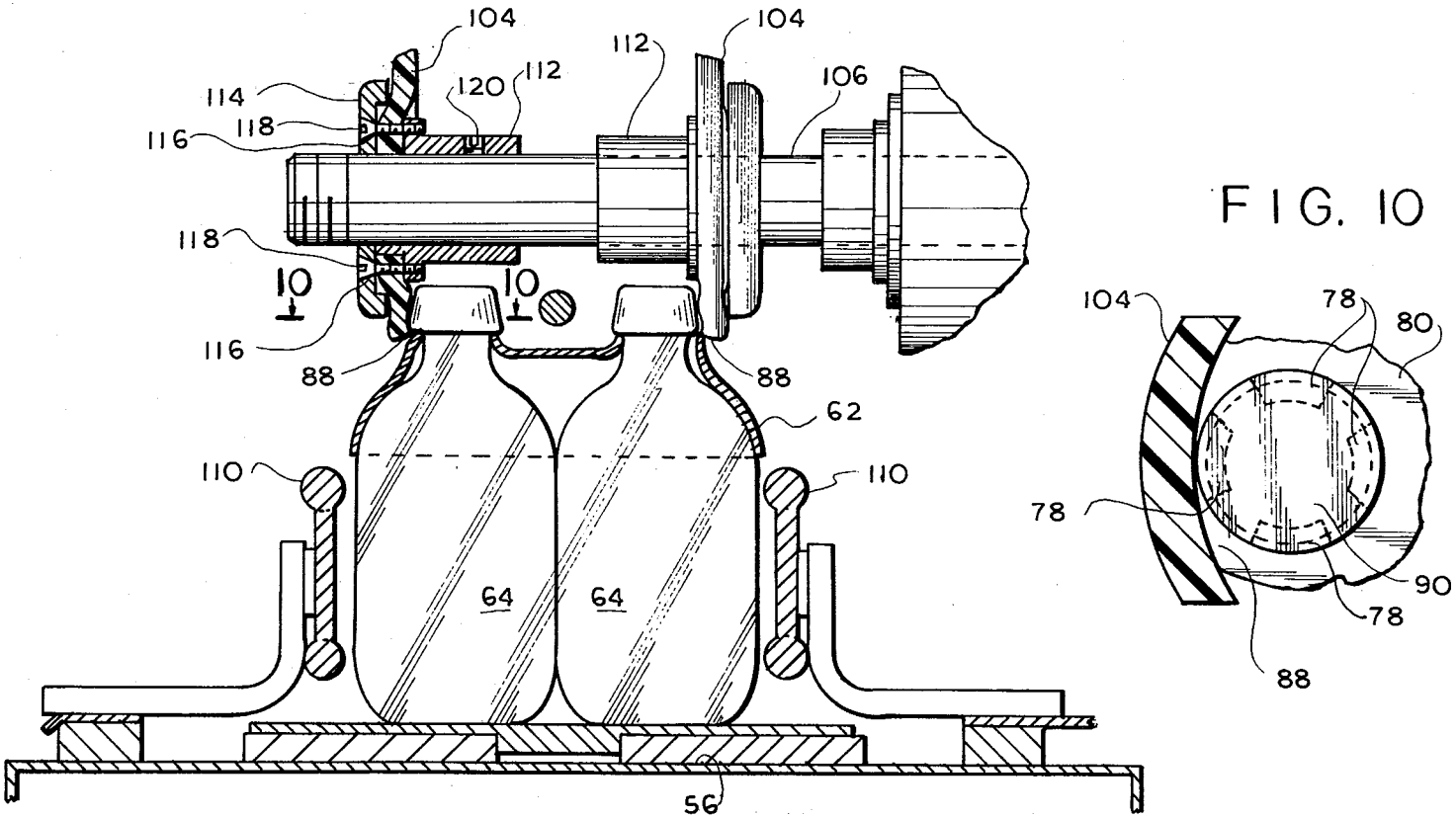
FIG. 9 is a front view taken along line 9—9 of FIG. 6.
FIG. 10 is a detailed view of the engaging means taken along line 10—10 of FIG. 9.

The manner in which this problem is overcome is illustrated in FIGS. 9 and 10. As shown in FIG. 9, each of the discs 104 is formed of a planar disc of deformable material which is retained between a hub 112 and a member 114. Member 114 has a planar central portion with a rim extending at right angles to the plane thereof. The central portion of member 114 is provided with a plurality of counter-sunk openings 116 into which the heads of screws 118 are situated. The externally threaded bodies of screws 118 are received in internally threaded apertures in hub 112, such that the discs 104 are tightly held therebetween. Hub 112 is mounted on shaft 106 by means of a set screw 120.

When hub 112, disc 104 and member 114 are assembled as shown; the rim of member 114, which extends at right angles to the plane thereof, causes deformable discs 104 to assume a dish-shaped or concave configuration. As a bottle cap 90 passes along the interior concave side of the disc 104, the disc 104 is deformed to at least partially assume the curvature of the cap, as shown in FIG. 10. This deformation causes the rim of a disc 104 to become curved so that it contacts narrow shoulder 88 on the surface 80 of carrier 62 over an increased surface area.

The concave configuration of disc 104 contributes substantially to the deformability thereof. The increased deformation permits contact over a greater surface area. Since the disc 104 contacts narrow shoulder 88 along a substantial surface area, the disc 104 can exert a positive downwardly directed force on the shoulder 88 such that the projections 78 adjacent thereto are always properly seated below the flange on the bottle. Thus, the deformable nature and concave configuration of discs 104 insure that the projections 78 along the outer periphery of surface 80 of carrier 62 are always properly seated.

Figure 11:
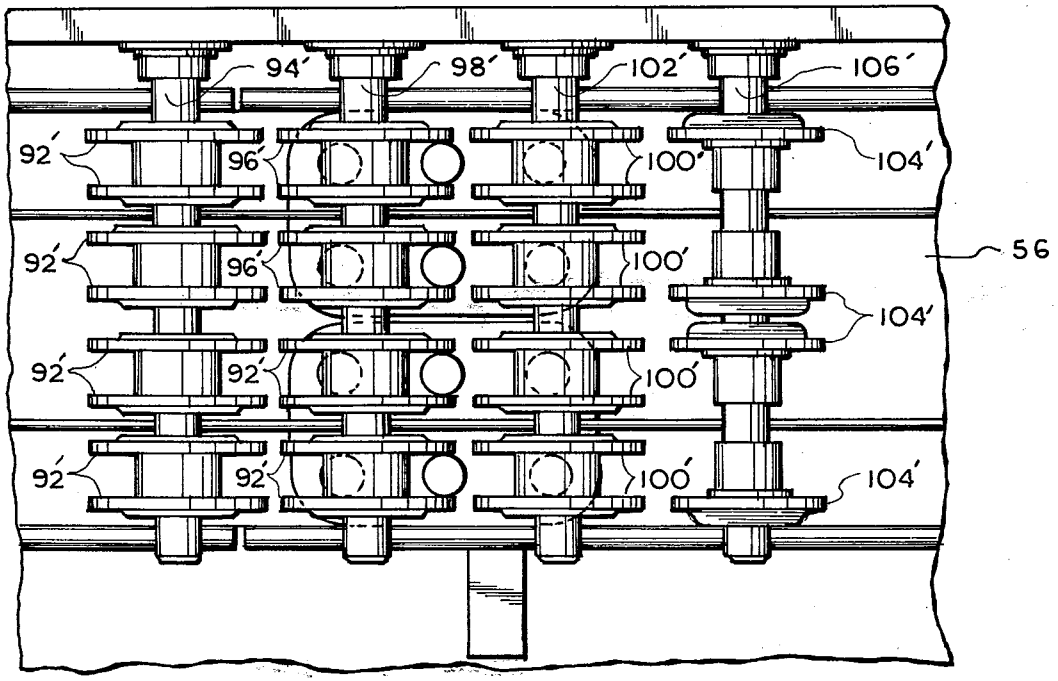
FIG. 11 is a plan view of a second preferred embodiment of the carrier applicator of the present invention.

FIG. 11 is a plan view of the seating means F of a second preferred embodiment of the present invention which is utilized with a four lane bottle conveyor to apply two side-by-side carriers to bottles simultaneously. With one notable exception, this embodiment contains parts identical to those illustrated in FIG. 7 with respect to the first preferred embodiment of the present invention, but certain of those parts have been duplicated in order to accommodate two more lanes of bottles and an additional carrier. For this reason, the parts shown in FIG. 11 have been designated with the same numbers as corresponding parts shown in FIG. 7, but have been primed to distinguish same.

The exception referred to above relates to the fact that star wheels normally cannot be used for alignment purposes when applying carriers to four lanes of bottles. The bottles are therefore put in cases before same are placed on the feed conveyors, such that the bottles are properly positioned by the cases before the carriers are applied.

As illustrated in FIG. 7, the width of belt 56 has been extended to accommodate four lanes of bottles 64. Shafts 94', 98' and 102' have been extended such that they can accommodate sets of planar deformable discs 92', 96', 100' consisting of eight discs each. Shaft 106' has been extended to accommodate four dish-shaped deformable discs 104'. As will now be obvious to one skilled in the art, the parts of seating means F, illustrated in FIG. 11, will function in the identical manner as the parts of sealing means F, illustrated in FIG. 7, except that two parallel carrier application operations take place simultaneously. For this reason, it is believed that a detailed explanation of the operation of the seating means illustrated in FIG. 11 would be redundant and is therefore omitted.

It will now be appreciated that the present invention is a carrier applicator incorporating a unique seating means which insures positive seating of each and every one of the engaging means of the carrier below the flanges of the bottles. Sufficient contact between the seating means and the narrow shoulder along the periphery of the top surface of the carrier is insured through the use of dish-shaped deformable discs located in alignment with the shoulder. Sets of planar deformable discs are situated to apply progressively increasing downwardly directed forces on the carrier prior to the operation of the dish-shaped discs so as to at least partially seat the carrier on the containers and to insure that the engaging means adjacent the central portion of the top surface of the carrier are properly seated. The combination of the planar discs sets and the dish-shaped discs insures that all of the engaging means will be properly seated in every case.

While only a limited number of preferred embodiments have been disclosed herein for purposes of illustration, it is obvious that many variations and modifications could be made thereto. It is intended to cover all of these variations and modifications which fall within the scope of the present invention as set forth in the following claims:

I claim:

1. Apparatus for applying a carrier to a pair of upstanding containers each having a neck with a flange, the carrier having means adapted to engage the neck of each container below the flange thereon, the apparatus comprising means for placing a carrier on the containers with the engaging means aligned with the necks of the containers, means for seating the engaging means below the flanges and means for supporting and moving the containers, with the carrier thereon, relative to said seating means, said seating means comprising first and second discs, each having a substantially continuous deformable periphery, and means for mounting said discs in spaced relation such that their respective peripheries are separated by a distance less than the distance between the outer peripheries of the flanges, but great enough to permit the flanges to pass therebetween, as the containers are moved relative to said seating means, each flange deforming the periphery of a different disc and each disc periphery exerting a force, towards said moving means, on the carrier at a location thereon adjacent the outer periphery of the respective flange.

2. The apparatus of claim 1, wherein each of said first and second disc peripheries comprises a concave interior wall.

3. The apparatus of claim 2, wherein each of said walls is engaged by the outer periphery of a different one of the flanges.

4. The apparatus of claim 1, wherein said first and second discs are co-axially aligned.

5. The apparatus of claim 1, wherein said first and second discs are rotatably mounted.

6. The apparatus of claim 1, wherein the carrier has an exterior shoulder situated adjacent said engaging means and wherein said location comprises said shoulder.

7. The apparatus of claim 1, wherein said first and second discs are upstanding.

8. The apparatus of claim 1, wherein said first and second discs are substantially parallelly situated.

9. The apparatus of claim 1, wherein said seating means further comprises first and said second disc sets, and means for mounting said first and second disc sets, in succession, upstream of said first and second discs along said moving means, said second disc set being mounted closer to said moving means than said first disc set.

10. The apparatus of claim 9, wherein each of said first and said second disc sets comprises four substantially parallelly situated, spaced, deformable discs.

* * * * *